United States Patent [19]

Greene et al.

[11] 4,039,821

[45] Aug. 2, 1977

[54] SELF-CONTAINED FLUORESCENT LAMP FIXTURE

[75] Inventors: Albert A. Greene, Cleveland; Emanuel A. Capadona, Garfield Heights, both of Ohio

[73] Assignee: Conserve-A-Watt Corporation, North Canton, Ohio

[21] Appl. No.: 528,627

[22] Filed: Dec. 2, 1974

Related U.S. Application Data

[63] Continuation-in-part of Ser. No. 500,252, Aug. 26, 1974, abandoned.

[51] Int. Cl.[2] ..... H05B 33/02

[52] U.S. Cl. ..... 240/51.11 R; 240/153; 339/154 L

[58] Field of Search ..... 240/51.11 R, 51.12, 240/153, 52.1; 339/8 R, 8 P, 8 PB, 8 PS, 153, 154 R, 154 A, 154 L

[56] References Cited

U.S. PATENT DOCUMENTS

| | | | |
|---|---|---|---|
| 2,871,455 | 1/1959 | Richardson | 240/51.11 R X |
| 2,943,238 | 6/1960 | Reaves | 240/51.12 X |
| 3,908,120 | 9/1975 | Greene | 240/51.11 R |

*Primary Examiner*—Fred L. Braun
*Attorney, Agent, or Firm*—Fay & Sharpe

[57] ABSTRACT

A new and improved self-contained fluorescent lamp fixture for installation in a conventional incandescent lamp fixture. The new and improved fixture includes an electrical lead wire pivot member for eliminating binding or entanglement of the electrical lead wires interconnecting the socket adaptor and the fluorescent tube and its operative components when the socket adaptor and fixture body cover are rotated relative to each other about the longitudinal axis of the socket adaptor in a plane generally normal thereto for installation and/or alignment purposes. Tool receiving openings are included in the periphery of the socket adaptor for purposes of receiving a hand tool or the like to facilitate tight threaded insertion of the socket adaptor into a conventional incandescent lamp socket. A tubular member is included on the socket adaptor to surround and extend outwardly generally coextensive with a male plug. This tubular member has a diameter greater than the diameter of the female socket outlet in a conventional incandescent lamp fixture in order that the tubular member may be received over and act as a safety guard for the male plug.

19 Claims, 4 Drawing Figures

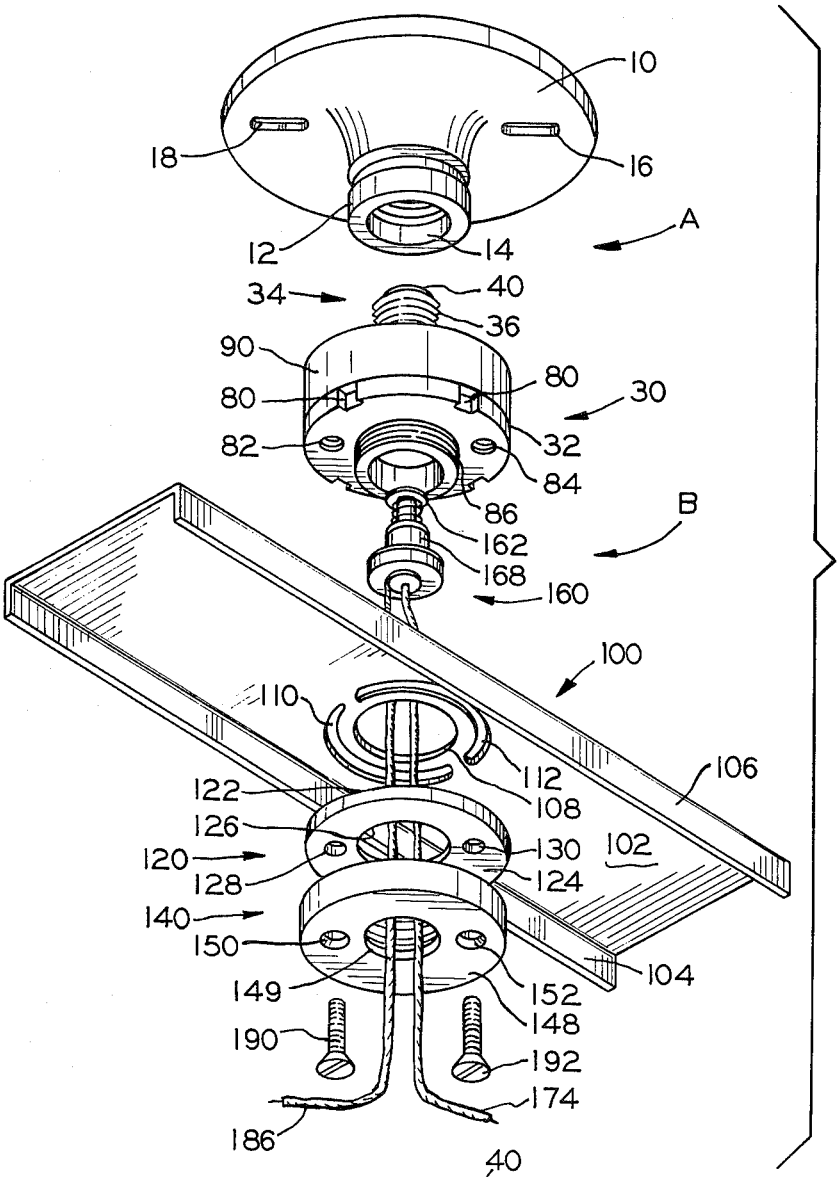
FIG. 1.
FIG. 2.
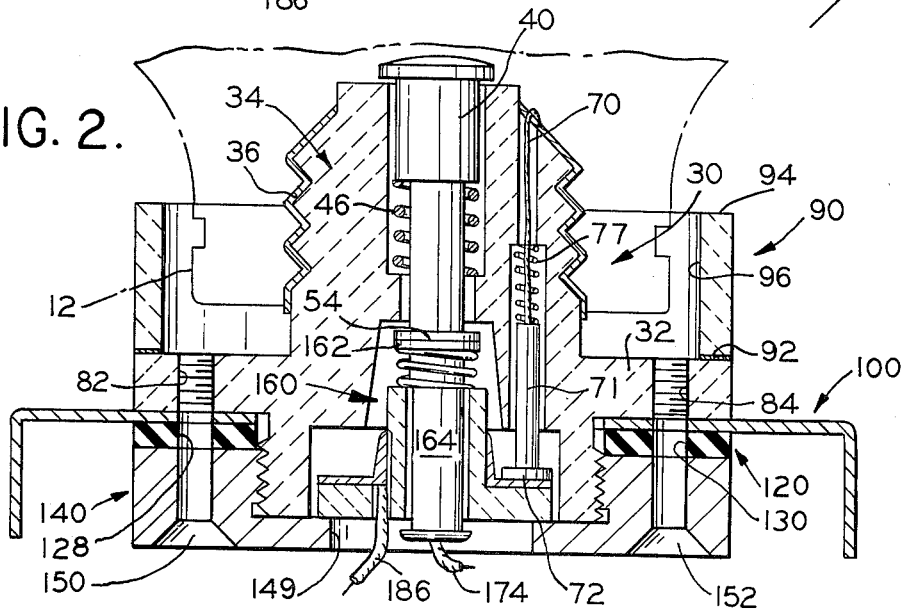

SELF-CONTAINED FLUORESCENT LAMP FIXTURE

BACKGROUND OF THE INVENTION

This application is a continuation-in-part of application Ser. No. 500,252, filed Aug. 26, 1974, now abandoned.

This invention pertains to the art of lamp fixtures and more particularly to fluorescent type lamp fixtures.

The invention is particularly applicable to self-contained fluorescent fixtures adapted to be installed in a conventional incandescent lamp socket outlet and will be described with particular reference thereto; however, it will be appreciated by those skilled in the art that the invention has broader applications and may be employed in other environments where it is desired to adapt one type of electrical fixture for use in a different type of electrical fixture socket.

Non-essential subject matter is incorporated hereinto by reference to the commonly assigned pending United States patent application having Ser. No. 480,419, filed June 18, 1974, now U.S. Pat. No. 3,908,120. In that applicaton, a new and improved self-contained fluorescent type lamp fixture was disclosed and the subject application represents an improvement to the structure described and claimed therein.

Certain undesirable structural charactristics have come to be known in using the structure disclosed and claimed in the earlier, commonly assigned applicaton which are deemed to be overcome by the invention of the subject application. Specifically, substantial inquiry has been made concerning the possibility of vandalic theft of fluorescent lighting fixtures which have been installed upon and within an incandescent lamp socket outlet. Low income housing developments, school dormitories and non-housekeeping dwellings which cater to a transient trade appear especially vulnerable to the problem associated with theft. Quite simply, when the lamp fixtures are merely conventionally threaded into the conventional incandescent lamp sockets, no means are provided to prevent or discourage others from easily removing the lamp fixture from the incandescent lamp socket and from the premises. Potential locking means as, for example, chains, cables and the like are not particularly desirable inasmuch as they add cost to the basic structure as well as detract from the overall aesthetic value of the fixtures.

In addition, at least the socket adaptor in such a self-contained fluorescent type lamp fixture is necessarily rotatable about the longitudinal axis of the incandescent lamp socket while the remainder of the fluorescent lamp fixture remains stationary to permit installation of the fixture into the incandescent lamp socket in close proximity to ceiling-wall junctures and other obstructions which would otherwise frustrate the rotational installation of straight fluorescent lamp fixtures into the incandescent lamp socket. Such obstructive conditions are far more frequent than originally contemplated or considered and require means by which the self-contained fluorescent lamp fixture may be easily installed into and within an incandescent socket outlet to achieve the economics of fluorescent lamp illumination when such conditions are present.

Although prior self-contained fluorescent lamp fixtures of this general type have normally taken the need for final fluorescent tube adjustment into consideration, such adjustments are normally provided over only a portion of one complete revolution and, therefore, are not at all satisfactory for permitting installation of the fluorescent lamp fixtures into an incandescent lamp socket when these ceiling-wall junctures and other obstructions are present.

BRIEF DESCRIPTION OF THE PRESENT INVENTION

The present invention contemplates an improved self-contained fluorescent lamp fixture adapted for installation in a conventional incandescent type lamp socket which overcomes the above referred to problems and others and provides an improved fixture which is simple in design, economical in construction, provides means for preventing theft of the structure, provides means to facilitate installation of the fixture adjacent ceiling-wall junctures and other obstructions and provides safety means for protecting persons from inadvertent electrical shock during periods of fixture adjustment, maintenance and removal.

In accordance with the present invention, there is provided a fluorescent lamp fixture which is adapted for installation into a conventional incandescent lamp socket. The fixture includes a socket adaptor receivable in the incandescent lamp socket for supporting the entire fixture. A fixture body cover is included which is adapted to receive and support a fluorescent light tube and its operative components in operative electrical association with the socket adaptor through a pair of conventional electrical lead wires wherein at least the fixture body cover and socket adaptor are selectively rotatable relative to each other about the longitudinal axis of the socket adaptor in a plane generally normal thereto. An electrical lead wire pivot is provided for maintaining continuous electrical contact of the lead wires between the socket adaptor and the fluorescent light tube and operative components to eliminate binding and entanglement of the lead wires during relative rotation between the fixture body cover and socket adaptor.

In accordance with another aspect of the present invention, the connector comprises a pivot member which receives the lead wires in an electrically insulated condition from each other. The pivot member includes a first contact for making continuous electrical contact for one of the lead wires with the outermost end of the socket adaptor and a second contact for making continuous electrical contact for the other of the lead wires with the adaptor screwshell.

In accordance with another aspect of the present invention, the adaptor includes a plurality of tool receiving means disposed therein. These receiving means comprise a plurality of tool receiving openings spaced peripherally around the adaptor and extending radially inward thereinto. The openings are adapted to receive a hand tool for assisting in moving the socket adaptor into and out of threaded engagement with a conventional incandescent lamp socket.

In accordance with still another aspect of the present invention, the adaptor includes a tubular member surrounding the male plug and extending outwardly generally coextensive therewith. This tubular member also has a diameter slightly greater than the diameter of the female socket outlet for a conventional incandescent lamp fixture. Thus, the tubular member acts as a protective sheath for the mating male-female electrical connection between the self-contained fluorescent lamp fixture and a conventional incandescent lamp fixture to prevent inadvertent electrical shocks.

In accordance with another aspect of the present invention, there is provided an improved electrical connection in a self-contained fluorescent lamp fixture of the type adapted for installation in a conventional incandescent lamp socket. The improvement is directed toward those lamp fixtures which include a socket adaptor receivable in theincandescent lamp socket and a fixture body adapted to eceive and support a fluorescent light tube and its operative components in operative electrical association with the socket adaptor through a pair of conventional electrical lead wires where at least the fixture body cover and socket adaptor are selectively rotatable relative to each other about the longitudinal axis of the socket adaptor in a plane generally normal thereto. Accordingly, a universal type connector member is provided to maintain continuous electrical contact of the lead wires between the socket adaptor and the fluorescent light tube and those other operative components disposed in the fixture body cover to eliminate binding or entanglement of the lead wires as the fixtue body cover and socket adaptor are rotated relative to each other.

In accordance with still a further aspect of the present invention, the socket adaptor of the improved fixture includes tool receiving means which may be employed to threadedly rotate the socket adaptor within a conventional incandescent lamp socket.

In accordance with yet a further aspect of the present invention, the socket adaptor also includes a member which acts as a protective sheath for the mating male-female electrical connection between the self-contained fluorescent lamp fixture and a conventional incandescent fixture.

The principal object of the present invention is the provision of a new and improved self-contained fluorescent lamp fixture which is adapted for installation directly into a conventional incandescent type lamp socket.

Another object of the present invention is the provision of a new and improved self-contained fluorescent type lamp fixture which includes means for eliminating electrical lead wire binding or entanglement when the fixture is installed in areas having closely associated ceiling-wall junctures or other obstructions.

Still another object of the present invention is the provision of a new and improved self-contained fluorescent lamp fixture which protects against inadvertent electrical shock during periods of fixture adjustment, maintenance and removal.

Another object of the present invention is the provision of a new and improved self-contained fluorescent lamp fixture which includes means for reducing theft of the fixture one it has been installed.

BRIEF DESCRIPTION OF THE DRAWINGS

The invention may take physical form in certain parts and arrangements of parts, preferred embodiments of which will be described in detail in the specification and illustrated in the accompanying drawings which form a part hereof and wherein:

FIG. 1 is an exploded perspective view of a fluorescent lamp fixture which includes the concepts of the subject invention;

FIG. 2 is a cross-sectional view of a portion of the lamp fixture shown in FIG. 1;

DESCRIPTION OF THE PREFERRED EMBODIMENT

Figure 3:
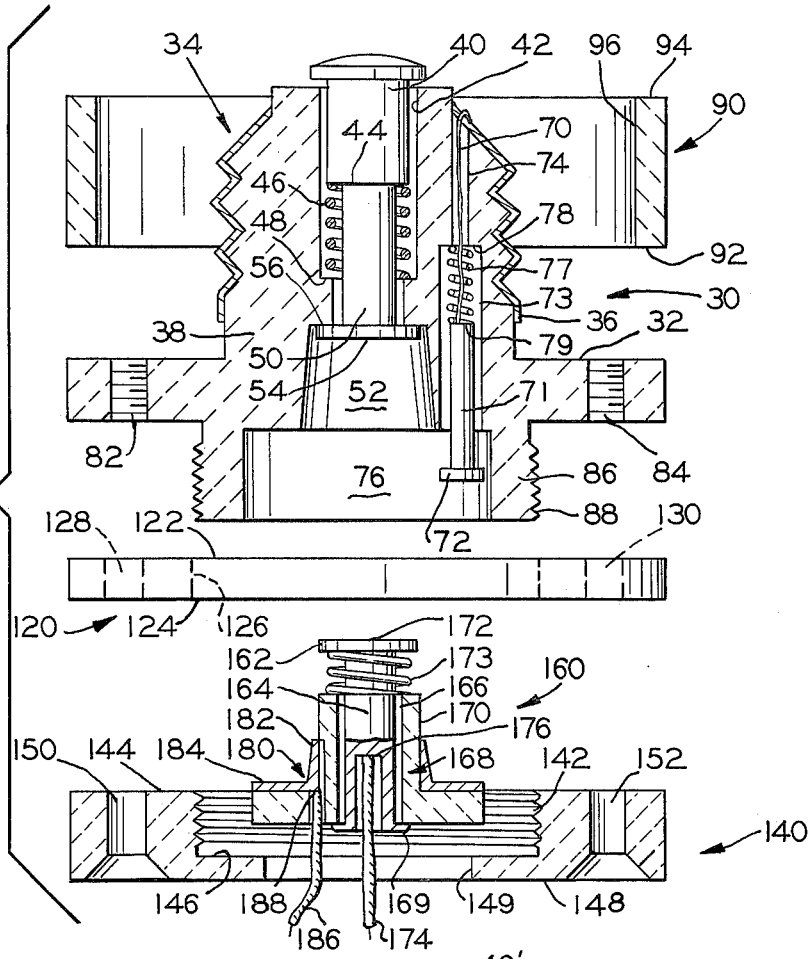
FIG. 3 is an exploded partial cross-sectional view of the preferred arrangement shown in FIG. 2; and, FIG. 4 is a partial cross-sectional view of an alternative arrangement for the subject invention.

Referring now to the drawings wherein the showings are for purposes of illustrating the preferred embodiment of the invention only, and not for purposes of limiting the same, the Figures show a conventional incandescent lamp fixture generally designated A and a self-contained fluorescent fixture generally designated B which comprises the focus of the subject invention.

A conventional incandescent lamp fixture normally comprises a ceramic or porcelain base 10 having an outwardly extending protrusion 12 which includes a female socket outlet 14 therein. This female socket is conventionally threaded and is connected to a source of electricity. Mounting slots 16, 18 disposed in base 10 provide convenient means for receiving conventional screws to mount the fixture to a wall, ceiling or the like as is known.

Fluorescent fixture B is comprised in part of a socket adaptor generally designated 30 which includes a collar portion 32 and an integral, outwardly extending screw-type male plug 34. The plug includes a threaded male screwshell 36 manufactured from a thin electrically conductive material and which ultimately makes electrical contact with the female socket outlet as is known. The remainder of both the collar and outwardly extending male plug portions 32, 34 are manufactued from an electrical insulating material with the male plug portion 34 having dimensional characteristics substantially similar to the inside contour of the screwshell itself.

The interior column of insulating material 38 extends beyond the outermost end of screwshell 36 into a dome-like configuration which insulates and surrounds an electrical pin contact 40. This pin contact is received in cavity 42 disposed longitudinally of the socket adaptor and which includes an intermediate flange 44 which interfaces with a coil spring 46 to continuously bias the pin contact longitudinally outward of the socket adaptor. The spring rests uon a shoulder 48 disposed along cavity 42 which then operates as a focal point of compression when the pin contact is depressed within the cavity. Lower pin shank 50 extends into a larger, tapered cavity 52 and is flared at its base 54 to intersect shoulder 56 which operates to capture the pin contact in position. The basic feature of this pin contact is known and used in the art to circumvent overtightening of the male plug 34 into female socket outlet 14 which could otherwise result in ripping or tearing the female screwshell out of its receptacle.

An additional feature of the "spring loaded" socket adaptor just described which is particularly applicable to the present invention is that by altering the design of spring member 46 and the placement of intersect shoulder 56, the relative compressive force may be effectively controlled. In this instance and in accordance with a basic law of physics that for every action the is an equal and opposite reaction, the controlled force created through the compression of spring member 46 in conjunction with intersect shoulder 56 is transposed to the threaded mating between male screwshell 36 and female socket outlet 14. Such a controlled force transfer operates to place the male and female screwshell threads into a biased relationship with one another to thereby substantially alleviate any tendency for the threads to disengage from each other. Such disengagement may be caused by, for example, vibrations which are normally present in most buildings and even partial disengagement may break the electrical circuit between the socket adaptor and female socket outlet.

An electrical lead wire 70 is affixed at one end to screwshell 36 and at the other end to an elongated contact member 71 having a lower pin shank 72. Contact member 71 is received in an enlarged portion 73 of a tubular orifice 74 extending generally downward through the insulating material and communicating with an enlarged cavity 76 disposed adjacent cavity 52. Contact member 71 is then placed in a position of potential compression by means of a coil spring 77 disposed within enlarged portion 73 of tubular orifice 74. This spring rests, on one end, against shoulder 78 between enlarged portion 73 and orifice 74 and, at the other end, against the uppermost end 79 of contact member 71. Member 71 is placed in actual compression when the fixture itself is assembled as will be described hereinafter. It should be particularly noted that the side walls of cavity 52 are tapered slightly inward from its outermost end. This configuration circumvents any interference or binding of contact member 71 when practicing the concepts of the subject invention as will hereinafter be described. It should also be appreciated that other arrangements for and locations of lead wire 70, contact 71 and orifice 74 may be employed without in any way departing from the scope and intent of the subject invention. Such variations may be employed primarily for ease of manufacture and operation.

Collar portion 32 comprises an upper collar in the overall strcture and, again, is preferably integral with the overall socket adaptor 30 structure. This portion also includes a plurality of inwardly extending, radially disposed slots or notches 80 disposed in the outer peripheral surface thereof and which are employed as an anti-theft device. These slots are provided to facilitate tight threaded installation and removal of socket adaptor 30 into and out of female socket outlet 14 through means of a hand tool adapted to be receive in the slots. Typically, such a tool could comprise a spanner type wrench or the like having at least one prong adapted to be selectively received in one of slots or notches 80 wherein additional tightening or loosening leverage may be applied to the socket adaptor through the wrench handle. Such tightening makes it extremely difficult to remove the fixture by hand once it has been installed. While the preferred arrangement as shown in the FIGURES contemplates four such slots equidistantly spaced around upper collar 32, a greater or lesser number of slots could also be employed. Likewise, other configurations such as radially disposed blind holes could be used in place of the slots shown without departing from the intent and scope of the invention.

A generally cylindrical or tubular member generally designated 90 comprised of an electrical insulating material is disposed on the uppermost surface of collar 32. While it is contemplated that member 90 will be a separate component affixed at end 92 to collar 32 by means of an adhesive cement, the member could be formed integrally with the collar. The outermost end 94 of member 90 is generally in horizontal alignment with the uppermost threads of metallic screwshell 36. The cylindrical or tubular member does not physically contact any electrically operative components of either socket adaptor 30 or a conventional incandescent lamp socket of the type designated A in FIG. 1. In this regard, attention is invited to FIG. 2 which shows the outline of such a conventional incandescent lamp socket in phantom lines as the self-contained fluorescent lamp fixture would be received thereinto.

Cylindrical tubular member 90 operates as a sleeve of dielectric material when the inner side wall 96 surrounds the outwardly extending ceramic or porcelain protrusion 12 which contains female socket outlet 14 therein. Member 90 thus functions as a mechanical barrier against inadvertent physical contact with electrically operative metallic screw-shell 36 on the male plug of the socket adaptor when the socket adaptor is installed within or removed from a receptacle outlet, that is, a conventional incandescent lamp socket, by means of a non-insulated tool or device. It has been discovered that a single diameter size of member 90 will accommodate the vast majority of conventional incandescent lamp fixture protrusions 12 as produced by various manufacturers. Use of member 90 also in no way frustrates utilization of slots 80 for installation and removal of the fluorescent lamp fixture as hereinabove described.

Upper collar portion 32 also includes a pair of oppositely disposed threaded holes 82, 84 which may be utilized in assembling the overall fluorescent lamp fixture in those instances where close ceiling-wall junctions and other obstructions are not a problem. The use of threaded holes 82, 84 and the assembly of the lamp structure is fully described in the abovementioned commonly assigned Ser. No. 480,419 patent application, the teachings of which are incorporated hereinto by reference. Extending outwardly of the lower face of upper collar 32 is a protrusion or shank 86 which includes threads 88 disposed about its outer periphery. Cavity 76 also extends through protrusion or shank 86. The structural function of this protrusion will become readily apparent hereinafter as the remainder of the subject invention is more fully described.

With particular reference to FIGS. 1 and 2, the subject new and improved fluorescent lamp fixture also employs a fluorescent tube fixture body cover generally designated 100 which comprises an elongated generally U-shaped member constructed from thin metal or other suitable material. This cover includes a top or main wall 102 having side walls 104, 106 depending therefrom along the opposed longitudinal edges thereof. Centrally disposed within the top or main wall 102 is a circular protrusion or shank receiving hole 108 adapted to facilitate close sliding receipt of the cover over protrusion or shank 86 and to permit the passing of the electrical lead wires therethrough. Disposed slightly outwardly of protrusion or shank receiving hole 108 is a pair of arcuate slots 110, 112 which may be employed to positively mount the fixture body cover and to facilitate some rotational movement thereof for alignment purposes when closely spaced ceiling-wall junctures or other obstructions are not present. This feature will be described in detail hereinafter and it should be noted that arcuate slots 110, 112 are aligned with the threaded receiving holes 82, 84 in upper collar portion 32.

The arrangement of the subject invention also contemplates use of a force or biasing means generally designated 120 on the other side of top or main wall 102 from upper collar 32. As in the abovementioned commonly assigned Ser. No. 480,419 patent, this force means comprises a generally flat washer-like member constructed from a resilient, compressible material.

Although neoprene has proved acceptable for constructing biasing means 120, it will be again appreciated that other such materials or arrangements could be employed without departing from the intent and scope of the present invention. This washer-like member includes a centrally located protrusion or shank receiving hole 126 adapted to slidably receive protrusion or extension 86 as well as to permit passing of the electrical lead wires. Face 122 is adapted to be placed in physical engagement with top or main wall 102 and face 124 is adapted to be placed in physical engagement with a lower collar which will be described hereinafter. This washer-like or annular member includes a pair of oppositely disposed fastener clearance holes 128, 130 which are aligned with threaded receiving holes 82, 84 and arcuate slots 110, 112 for providing an alternate fixture assembly method.

Flourescent fixture assembly B includes a flat, circular lower collar generally designated 140 which is constructed from an electrical insulating material. This lower collar includes a threaded protrusion or shank receiving hole 142 (FIG. 3) receivable on threads 88 of protrusion or shank 86 for compressing force or biasing means 120 against fixture body cover 100 while simultaneously locking an electrical lead wire pivot, to be described in detail hereinafter, in its proper position. As best shown in FIGS. 1 and 3, upper face 144 of this lower collar is adapted to engage face 124 of the force or biasing means to force face 122 into engagement with top or main wall 102 of the fixture body cover. The degree of such compression is primarily controlled by the number of turns the lower collar is threaded onto protrusion or shank 86. Threads 142 do not extend entirely through lower collar 140 from upper face 144 and extend to a shoulder area 146 disposed adjacent the lower face 148 thereof with a lead wire clearance hole 149 passing from the shoulder area 146 through the lower face. Shoulder area 146 operates to retain an electrical pivot to be described hereinafter in position within the fluorescent lamp fixture assembly.

In addition, the lower collar includes a pair of threaded fastener clearance holes 150, 152 oppositely disposed from each other and in alignment with clearance holes 128, 130, arcuate slots 110, 112 and threaded fastener receiving holes 82, 84 for purposes of assembling the lamp fixture wherein neither obstructions nor theft of the fixture is of concern.

An important aspect of the present invention is the development and incorporation of an electrical pivot member generally designated 160 in FIGS. 1, 2 and 3. This pivot includes a generally upwardly extending metallic tip or contact 162 having a lower pin 164 slidably received in a tubular orifice 166 in an electrical insulating material 168. A flared base 169 included at the lowermost end of pin 164 operates against the bottom of insulating material 168 to retain the pin in orifice 166. The upper shank side wall 170 of insulating mateial 168 and the outermost side wall of metallic tip of contact 162 are dimensioned to be closely slidably received in cavity 52 of socket adaptor 30. The top 172 of metallic tip 162 acts as a vertical pivot point in direct physical contact with flared base 54 of lower pin shank 50. A spring biasing means 173 is disposed and retained between the lower surface of tip or contact 162 and the upper surface of insulating material 168 to continuously urge the pin or contact upwardly until flared base 169 engages the bottom surface of insulating material 168. It has been found that pin or contact 162 must move in unison with electrical pin contact 40 in order to render the structure beneficially operative when the fluorescent lamp fixture is fully assembled and installed as will be described hereinafter. If pin or contact 162 was rigidly located in insulating material 168, flared base 54 on pin shank 50 will bottom out on top 172 as the fluorescent fixture is installed in an incandescent lamp fixture. Such bottoming out would circumvent rotational movement of pivot member 160 while simultaneously placing undesired and unacceptable stress, strain and tension on the electrical lead wires.

A first electrical lead wire 174 is conveniently affixed to lower pin 164 as at, for example, a recessed juncture 176 therein. As a result of this structure, electrical energy is conducted through pin contact 40, through lower pin shank 50, through flared base 54, through metallic tip 172, through lower pin 164, through first electrical lead 174 and into the conventional operative components contained within the fluorescent lamp fixture. This conduction is facilitated without placing any tension or strain or entanglement upon electrical lead wire 174 when the socket adaptor itself is rotated about its longitudinal axis relative to the remainder of the fixture.

Electrical pivot or connector 160 additionally includes a metallic hub 180 which is disposed about and upon insulating material 168 near the central section of the electric pivot structure. The central and lower sections of the electrical pivot are dimensioned to be closely and slidably received within cavity 76 at the side wall thereof. In the preferred arrangement of the present invention shown in FIGS. 1, 2 and 3, metallic hub 180 is annular or washer-shaped having a generally "L" shaped cross section with a side wall 182 and a bottom wall 184 and is engaged at bottom wall 184 by lower pin shank 71 of contact member 72 when the pivot is fully inserted into cavities 52, 76. A second electrical lead wire 186 is conveniently affixed to the base or bottom portion of hub 180 through a receiving junction 188 disposed in insulating material 168. The electrical circuit is then completed whereby electrical energy is conducted through screwshell 36, through wire lead 70, through spring loaded contact member 72, through metallic hub 180, through electrical lead wire 186 and into the conventional operative components within the fluorescent lamp fixture, all without placing tension, strain or entanglement upon electrical lead wire 186 when the socket adaptor is rotated about its longitudinal axis relative to the remainder of the fixture.

In using the embodiment of the subject invention just described, description will now be made when the self-contained fluorescent lamp fixture is to be mounted in an area of close ceiling-wall juncture or when other obstructions are present. With the fixture assembled as shown in FIG. 2 and with lower collar 140 threaded on extension or shank 86 of socket adaptor 30 to its final position so that force or biasing means 120 is compressed such that relative movement between the adaptor and the remainder of the fixture may be obtained by a hand applied force, socket adaptor male plug 34 is inserted and threaded into female socket outlet 14. Thus, as the socket adaptor is rotated for threaded engagement into the female outlet, the fixture body cover may remain stationary as when, for example, it engages a ceiling-wall juncture or other obstruction which would otherwise prevent total threaded insertion of the adaptor into the female socket outlet. This structural arrangement, therefore, overcomes this problem by allowing full relative rotation between the adaptor and fixture body cover.

Once final insertion of the male plug has been completed, the fixture body cover may then be aligned to its final desired position by a rotational force applied to the fixture body cover by a workman. As fully explored in the abovementioned commonly assigned Ser. No. 480,419 patent application, non-essential teachings of which are incorporated herein by reference, a frictional type force is created between the fixture components by compressing member 120. This force acts to resist relative rotation between the socket adaptor and fixture body cover. This resistance may, of course, be overcome by a workman during both actual fixture installation and final fixture alignment but such resistance has been found sufficient to eliminate undesired rotational movement caused by normal vibrations, nudges or the like. Naturally, the greater the degree of compression of the compressible washer, the greater the amount of frictional force generated between the washer, the upper collar, the fixture body cover and the lower collar.

With the fixture in the assembled condition, shoulder area 146 of the lower collar operates in combination with the lowermost surface of electrical pivot 160 to capture and retain the pivot within cavities 52, 76 of the socket adaptor. Inasmuch as the electrical pivot or connector is slidably received in cavities 52, 76 and is slidably retained by shoulder 146, the pivot will rotate independent of socket adaptor rotation during threaded insertion of the male plug 34 into female socket outlet 14. As the male plug is so inserted, pin contact 40 is driven downwardly against contact 162. Such driving overcomes the upward biasing force of springs 46 and 173 so that flared base 169 is forced away from its contact with the bottom surface of insulating material 168. As described above, such action prevents binding or bottoming out of contacts 40 and 162 against each other. In this manner of operation of pivot 160, electrical lead wires 174, 186 do not bind or become entangled during the installation process which can otherwise cause substantial difficulty in those areas of installation having close ceiling-wall junctures or other obstructions in close proximity with the incandescent lamp fixture. In addition, and if self-contained fluorescent fixture B is to be mounted in an area of high vandalic thievery and the like potential, a spanner type wrench having a prong adapted to engage at least one of tool receiving slots or notches 80 may be employed to firmly tighten the socket adaptor in the female socket outlet in order that a fixture may not be moved from association with the incandescent lamp fixture by hand. Of course, the same tool may be employed for unthreading the adaptor if and when it should become necessary and tubular member 90, while protecting from potential electrical shock, will not interfere with such installation or removal.

If the subject lamp fixture is to be used in an environment where close ceiling-wall junctions or other obstructions will not be a factor or problem, the fixture may be alternatively assembled by means of threaded fasteners 190, 192 received through holes 150, 152; 128, 130; slots 110, 112; and, into threaded engagement with holes 82, 84. This aspect of assembly is fully explained in the abovementioned commonly assigned application having Ser. No. 480, 419 and limits rotation of the fixture body cover to approximately 170°. Such rotation is deemed sufficient when the only concerns present are those of proper fixture alignment.

Figure 4:
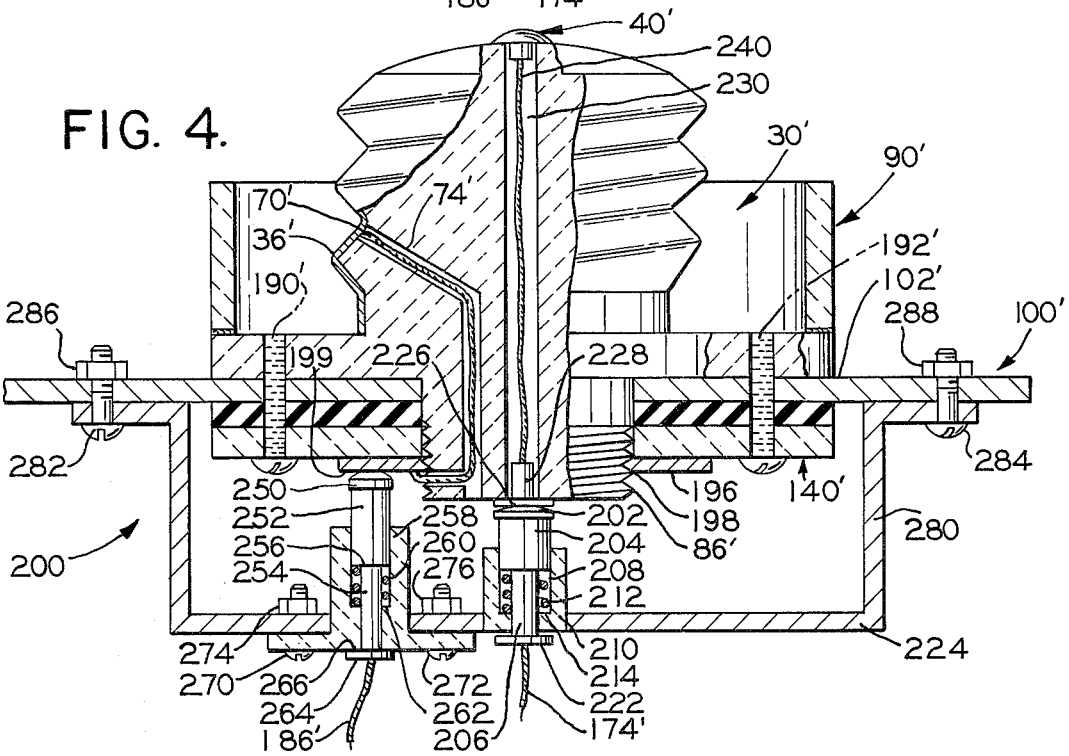

Turning now to an alternative arrangement for the concepts of the subject invention, attention is particularly invited to FIG. 4. This embodiment of the invention contemplates a different arrangement for providing rotational movement thereof. Accordingly, the basic fixture structure and operation are identical with that already described herein with reference to the other FIGS. There are, however, differences in the socket adaptor structure and the mode of connection between the adaptor and the electrical lead wires which will be described and like components are designated by like numerals which include a prime (') suffix and new components are designated by new numerals.

In this arrangement, lower collar 140' includes a metallic communicator ring 196 conveniently disposed thereagainst and, in the preferred embodiment, this ring is threadedly received within threaded juncture 198 by protrusion or shank 86' of socket adaptor 30'. Wire 70' passing through orifice 74' may either be affixed to the lower contact surface 199 of communicator ring 196 as is shown in FIG. 4 or sandwiched between the outermost face of lower collar 140' and the upper surface of the communicator ring. As with the embodiment of FIGS. 1–3, the form and location of wire 70' and orifice 74' may vary for purposes of ease of manufacture and operation without departing from the scope and intent of the present invention.

There is also provided a multi-pivotal support structure generally designated 200 which includes at least two individual spring loaded electrical pivot contacts mounted upon a supporting structure which is affixed to fixture body cover 100'. The centermost pivot contact 202 includes an upper pin shank 204 and a lower pin shank 206 which reside within orifice 208 of a tubular housing 210 of insulating material. A compressible coil spring 212 is disposed between the bottom of upper pin shank 204 and a shoulder 214 included in housing 210. Lower pin shank 206 is flared outwardly at its lowermost end 222 for upward restraint at bottom surface 224 of the overall supporting structure. Tubular housing 210 may be restrained in position in the support structure 200 by any number of convenient means.

First electrical lead wire 174' is affixed by convenient means to pin shank 206. When centermost pivot contact 202 is placed in mating contact with lower surface 226 of lower pin contact 228, received in hole 230 extending longitudinally through socket adaptor 30', spring 212 is placed in compression to exert a biasing force upon mating surfaces 202, 226. As a result, electric energy is conducted through pin contact 40' disposed in the other end of hole 230 at the outermost end of the socket adaptor, through a lead wire 240 connecting pin contact 40' and lower pin contact 228, through lower pin contact 228, through centermost pivot contact 202, through upper pin shank 204 and lower pin shank 206, through electrical lead wire 174' and into the operative components of the fluorescent lamp fixture. This arrangement facilitates the supply of electric energy to the operative components without placing tension or strain upon electrical lead wire 174' when socket adaptor 30' is rotated about its longitudinal axis independent of the remaining fixture components.

Offset pivot contact 250 also includes an upper pin shank 252 and a lower pin shank 254 which reside within an orifice 256 of a tubular housing 258 comprised of electrical insulating material. A compressible coil spring 260 is disposed between the bottom portion of upper pin shank 252 and a shoulder 262 included in the insulating material. Lower pin shank 254 is flared outwardly at bottom portion 264 for upward restraint at the bottom flange surface 266 of tubular housing 258. Tubular housing 258 is restrained against displacement created by the lateral force of contact surfaces 199, 250 during rotation by way of reinforcement screws 270, 272 passing the insulating material and through the support structure itself for retention in position by conventional washers and nuts 274, 276. If desired, a similar structural arrangement could conveniently be employed for tubular housing 210.

The second electrical lead wire 186' is conveniently affixed to pin shank 254. When offset pivot 250 is placed in sliding contact with lower contact surface 199 of communicator ring 196, spring 260 is placed in compression to exert a biasing force against mating surfaces 199, 150. Communicator ring 196 rotates in a sliding motion across stationary offset pivot contact 250. Therefore, an electrical circuit is completed whereby electric energy is conducted through screwshell 36', through lead wire 70', through communicator ring 196, through offset pivot contact 250, through upper pin shank 252, through lower pin shank 254, through electrical lead wire 186' and into the operative components of the fluorescent lamp fixture. Again, this structure does not place tension or strain upon lead wire 186' when socket adaptor 30' is rotated about its longitudinal axis independent of the other components.

The above described arrangement and multi-pivotal contacts 202, 250 may be conveniently affixed to a block U-shaped channel configuration 280 which may then be conveniently rigidly affixed to the inside portion of top or main wall 102' of fixture body cover 100' by, for example, threaded fasteners 282, 284 and associated washers and nuts 286, 288.

With the arrangement just described, the socket adaptor may be forcibly and unrestrictedly rotated about the longitudinal axis of the fluorescent fixture body cover 100'. Again, however, if close ceiling-wall junctures or other obstructions will not be a problem, it is possible to employ threaded fasteners 190', 192', shown in phantom in FIG. 4, in a manner hereinabove described with reference to the FIGS. 1–3 embodiment.

The invention has been described with reference to preferred embodiments. Obviously, modifications and alternations will occur to others upon the reading and understanding of the specification. It is our intention to include all such modifications and alterations insofar as they come within the scope of the appended claims or the equivalents thereof.

Having thus described our invention, we now claim:

1. In a self-contained fluroescent lamp fixture of the type adapted for installation in a conventional incandescent lamp socket wherein there is included a socket adaptor having an outermost end and an outer side wall receivable in said socket and a fixture body cover communicating with said socket adaptor adapted to receive and support a fluorescent light tube and its operative components in an operative electrical association with said socket adaptor by a pair of conventional lead wires wherein at least said fixture body cover and socket adaptor are rotatable relative to each other about the longitudinal axis of said socket adaptor in a plane generally normal thereto, the improvement comprising:

a separate electrical pivot member generally longitudinally slidably received in the end of said socket adaptor adjacent said fixture body cover and receiving said lead wires therein for maintaining continuous electrical contact of said lead wires between said socket adaptor and the fluorescent light tube and operative components disposed in said fixture body cover to eliminate binding and entanglement of said wires as said fixture body cover and socket adaptor are rotated relative to each other, said pivot member including a first contact for making continuous electrical contact for one of said lead wires with said socket adaptor outermost end and a second contact for making continuous electrical contact for the other of said lead wires with said socket adaptor outer side wall.

2. The improvement as defined in claim 1 further including a protective sheath spaced from and substantially surrounding the outer side wall of that portion of said socket adaptor adapted to be received in a incandescent lamp socket.

3. The improvement as defined in claim 2 wherein said sheath is electrically insulated extending generally coextensive with said socket adaptor and is spaced therefrom a distance whereby said sheath will closely surround at least a portion of an incandescent lamp socket as said socket adaptor is inserted thereinto.

4. A self-contained fluorescent lamp fixture adapted for installation into a conventional incandescent lamp socket, said lamp fixture comprising in combination:

a socket adaptor having an outermost end and an outer side wall receivable in said socket for supporting said fluorescent fixture, said socket adaptor including a first pin contact extending longitudinally through a portion thereof from said outermost end and a second pin contact electricallly connected to said outer side wall;

a fixture body cover communicating with said socket adaptor adapted to receive and support a fluroescent light tube and its operative components in operative electrical association with said socket adaptor through a pair of conventional electrical lead wires wherein at least said fixture body cover and socket adaptor are selectively rotatable relative to each other about the longitudinal axis of said socket adaptor in a plane generally normal thereto; and, a separate electrical pivot member generally longitudinally slidably received in the end of said socket adaptor adjacent said fixture body cover for maintaining continuous electrical contact of said lead wires between said socket adaptor and the fluorescent light tube and operative components disposed in said fixture body cover and to eliminate binding and entanglement of said wires when said fixture body cover and socket adaptor are rotated relative to each other, said pivot member receiving said lead wires in an electrically insulated condition from each other and including a first contact for making continuous electrical contact for one of said lead wires with said socket adaptor first pin contact and a second contact for making continuous electrical contact for the other of said lead wires with said socket adaptor second pin contact.

5. The lamp fixture as defined in claim 4 wherein said pivot member first contact is continuously biased toward engagement with said socket adaptor first pin contact and said socket adaptor second pin contact is continuously biased toward engagement with said pivot member second contact.

6. The lamp fixture as defined in claim 4 wherein said pivot member has an outer side wall, at least a portion of said pivot member outer side wall being comprised of an electrically conductive material and defining said second contact adapted to be in continuous engagement with said second pin contact.

7. The lamp fixture as defined in claim 4 wherein said fixture further includes a lower collar affixed to said socket adaptor with said fixture body cover disposed between said adaptor and lower collar, said collar including means for retaining said pivot member in position in said adaptor while allowing relative rotational movement between said pivot member and said adaptor.

8. The lamp fixture as defined in claim 4 wherein said adaptor includes an associated upper collar having a engaging face for engaging said fixture body cover, said collar having an outer peripheral surface including tool receiving means for receiving a hand tool to facilitate tight rotational insertion of said adaptor in said conventional incandescent lamp socket.

9. The lamp fixture as defined in claim 8 wherein said tool receiving means comprises a plurality of tool receiving openings spaced around said outer peripheral surface to extend radially inward therefrom, said openings each adapted to receive said hand tool.

10. The lamp fixture as defined in claim 4 wherein said adaptor includes an associated upper collar having an engaging face for engaging said fixture body cover, said collar including a protective sheath spaced from and substantially surrounding the side wall of that portion of said socket adaptor adapted to be received in an incandescent lamp socket.

11. The lamp fixture as defined in claim 10 wherein said sheath is electrically insulated and extends generally coextensive with said socket adaptor, said sheath being spaced from said socket adaptor a distance whereby said sheath will closely surround at least a portion of an incandescent lamp socket into which said socket adaptor is inserted.

12. A self-contained fluorescent lamp fixture adapted for installation into a conventional incandescent lamp socket and comprising in combination:

a socket adaptor having an outermost end and an outer side wall receivable in said socket for supporting said fluorescent lamp fixture, said socket adaptor including a first pin extending longitudinally through a portion thereof from said outermost end and a second contact electrically connected to said outer side wall;

a fixture body cover adapted to receive and support a fluorescent light tube and its operative components in operative electrical association with said socket adaptor through a pair of conventional electrical lead wires wherein at least said fixture body cover and socket adaptor are selectively rotatable relative to each other about the longitudinal axis of said socket adaptor in a plane generally normal thereto;

a lower collar member affixed to said socket adaptor with said fixture body cover disposed between said socket adaptor and said lower collar; and, a separate electrical pivot member generally longitudinally slidably received in the end of said socket adaptor adjacent said fixture body cover for maintaining continuous electrical contact of said lead wires between said socket adaptor and the fluorescent light tube and operative components disposed in said fixture body cover and to eliminate binding and entanglement of said wires when said fixture body cover and socket adaptor are rotated relative to each other, said pivot member having a first contact for making continous electrical contact for one of said lead wires with said socket adaptor first pin contact and a second contact for making continuous electrical contact for the other of said lead wires with said socket adaptor second pin contact.

13. The lamp fixture as defined in claim 12 wherein said pivot member first contact is continuously biased toward engagement with said socket adaptor first pin contact and said socket adaptor second pin contact is continuously biased toward engagement with said pivot member second contact.

14. The lamp fixture as defined in claim 12 wherein said pivot member has an outer side wall, at least a portion of said pivot member outer side wall being comprised of an electrically conductive material and defining said second contact adapted to be in continuous engagement with said second pin contact.

15. The lamp fixture as defined in claim 12 wherein said lower collar includes means for retaining said pivot member in position in said adaptor while allowing relative rotational movement between said pivot member and said adaptor.

16. The lamp fixture as defined in claim 12 wherein said adaptor includes an associated upper collar having an engaging face for engaging said fixture body cover, said collar having an outer peripheral surface including tool receiving means for receiving a hand tool to facilitate tight rotational insertion of said adaptor in said conventional lamp socket.

17. The lamp fixture as defined in claim 16 wherein said tool receiving means comprises a plurality of tool receiving openings spaced around said outer peripheral surface to extend radially inward therefrom, said openings each adapted to receive said hand tool.

18. The lamp fixture as defined in claim 12 wherein said adaptor includes an associated upper collar having an engaging face for engaging said fixture body cover, said collar including a protective sheath spaced from and substantially surrounding the side wall of that portion of said socket adaptor adapted to be received in an incandescent lamp socket.

19. The lamp fixture as defined in claim 18 wherein said sheath is electrically insulative and extends generally coextensive with said socket adaptor, said sheath being spaced from said socket adaptor a distance whereby said sheath will closely surround at least a portion of an incandescent lamp socket into which said socket adaptor is inserted.

* * * * *